US012110464B2

(12) United States Patent
Patel et al.

(10) Patent No.: US 12,110,464 B2
(45) Date of Patent: Oct. 8, 2024

(54) PHASE CHANGE MATERIALS TO ADDRESS REVERSION PROBLEMS IN HEAVY OILS

(71) Applicant: Baker Hughes Oilfield Operations LLC, Houston, TX (US)

(72) Inventors: Asha Patel, Houston, TX (US); Kekeli A. Ekoue-Kovi, Rosenberg, TX (US); Sankaran Murugesan, Katy, TX (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 0 days.

(21) Appl. No.: 17/732,380

(22) Filed: Apr. 28, 2022

(65) Prior Publication Data

US 2023/0348806 A1 Nov. 2, 2023

(51) Int. Cl.

| | |
|---|---|
| ***C10L 10/14*** | (2006.01) |
| ***C10L 1/14*** | (2006.01) |
| ***C10L 1/196*** | (2006.01) |
| ***C10L 1/236*** | (2006.01) |
| ***C10L 10/16*** | (2006.01) |

(52) U.S. Cl.
CPC ..... *C10L 10/14* (2013.01); *C10L 1/146* (2013.01); *C10L 1/196* (2013.01); *C10L 1/2364* (2013.01); *C10L 10/16* (2013.01); *C10L 2250/04* (2013.01)

(58) Field of Classification Search
CPC ..... C10L 10/14; C10L 10/16; C10L 1/2364; C10L 2250/04
See application file for complete search history.

(56) References Cited

U.S. PATENT DOCUMENTS

| | | | | |
|---|---|---|---|---|
| 5,082,056 | A | 1/1992 | Tackett | |
| 6,319,599 | B1 | 11/2001 | Buckley | |
| 8,308,861 | B2 * | 11/2012 | Rolland | E04B 1/78 428/221 |
| 9,938,365 | B2 | 4/2018 | Hartmann et al. | |
| 9,957,779 | B2 | 5/2018 | Fursdon-Welsh et al. | |
| 10,829,675 | B2 | 11/2020 | Formato et al. | |
| 2010/0269406 | A1 * | 10/2010 | Moreton | C10L 10/16 568/793 |
| 2014/0094537 | A1 * | 4/2014 | Schmidt | C10L 1/1973 524/401 |
| 2016/0022326 | A1 | 8/2016 | Hartman | |
| 2020/0197327 | A1 | 6/2020 | Wening et al. | |
| 2021/0139760 | A1 | 5/2021 | Sawafta et al. | |

FOREIGN PATENT DOCUMENTS

| | | | |
|---|---|---|---|
| CN | 1032184 | A | 4/1989 |
| CN | 1114676 | A | 1/1996 |
| CN | 1786101 | A | 6/2006 |

(Continued)

OTHER PUBLICATIONS

"Phase Change Materials: Thermal Management Solutions", PCM products Ltd, Brochure; date unknown, 5pp.

(Continued)

*Primary Examiner* — Ellen M McAvoy
*Assistant Examiner* — Ming Cheung Po
(74) *Attorney, Agent, or Firm* — Crowe & Dunlevy, P.C.

(57) ABSTRACT

Reversion problems with heavy oils, such as heavy fuel oils, are mitigated by introducing an effective amount of an additive that contains both a phase change material and a pour point depressant, even synergistically mitigated.

14 Claims, 2 Drawing Sheets

(56) References Cited

FOREIGN PATENT DOCUMENTS

| | | | | | |
|---|---|---|---|---|---|
| CN | 1325598 | C | | 7/2007 | |
| CN | 101838565 | B | | 1/2015 | |
| CN | 113122349 | A | | 7/2021 | |
| JP | 5357597 | B2 | | 9/2013 | |
| WO | WO-2011001177 | A2 | * | 1/2011 | ..... F01K 3/02 |
| WO | WO-2011099871 | A1 | * | 8/2011 | ..... C07C 67/303 |
| WO | WO-2011161472 | A1 | * | 12/2011 | ..... F16L 59/143 |

OTHER PUBLICATIONS

International Search Report and Written Opinion issued in conection with corresponding PCT Application No. PCT/US2023/019510 dated Aug. 23, 2023.

* cited by examiner

PHASE CHANGE MATERIALS TO ADDRESS REVERSION PROBLEMS IN HEAVY OILS

TECHNICAL FIELD

The present invention relates to methods and compositions for mitigating reversion problems in heavy oils, and more particularly relates to methods and compositions for mitigating reversion problems in heavy oils by introducing therein at least one pour point depressant.

BACKGROUND

Fuel oils, crude oils, refinery fluids, lubricants and/or petroleum products often contain fouling components, e.g., paraffins, waxes, etc. that may agglomerate or precipitate, particularly at low temperatures, as large crystals in such a way that may cause the oil to lose its ability to flow, i.e., the pour point becomes higher because of the fouling components within the fluid. The "pour point" of a fluid is the temperature at which a fluid ceases to pour. One test to determine the pour point is the ASTM D-97 pour point test where the oil ceases to flow at a given temperature (the pour point) when the sample is held at 90 degrees to the upright for five seconds. Higher pour points are typically associated with crude oils having significant paraffin or wax content because these fouling components begin precipitating as the temperature of the fluid decreases. At some point, the precipitates may accumulate and/or agglomerate to the point where the fluid will no longer flow. "Fouling component" is defined herein to be any component that may agglomerate or precipitate in a fluid.

As the temperature of the fluid falls and approaches the pour point, difficulties arise in transporting the fuel or lubricant through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils and lubricants. Similarly, other additives have been proposed and are in commercial use for reducing the size and changing the shape of the wax crystals that do form. Smaller size crystals are desirable since they are less likely to clog a filter, but these smaller crystals may still agglomerate and form larger crystals and subsequently pose the same problem of plugging or clogging various types of well equipment. Thus, it would be beneficial to also prevent the smaller crystals from agglomerating and/or precipitating, or otherwise accumulating.

Heavy oils also have a "reversion issue". Reversion issues occur during thermal cycling and/or mechanical shearing of heavy fuels such as fuel oils, marine fuels, gas oils and bottom resids. During thermal cycling and mechanical shearing, the heavy oil has tendency to undergo gelation that causes difficulty to pump and utilize properly. Generally, again pour point depressants (PPDs) are utilized as an additive to address the some of the challenges of fuel flowability and temperature. However, in some cases these additives cannot and do not address this problem due to nature of the fuel and its handling.

It is thus desirable to mitigate reversion issues in heavy oils.

SUMMARY

There is provided, in one non-restrictive form, a method to mitigate a reversion problem of a heavy oil, comprising introducing into the heavy oil having the reversion problem an effective amount of an additive to mitigate the reversion problem where the additive comprises both a phase change material and a pour point depressant thereby providing a treated heavy oil.

Additionally, there may be provided in a non-limiting embodiment, a treated heavy oil that includes heavy oil having a reversion problem and an effective amount of an additive to mitigate the reversion problem where the additive comprises both a phase change material and a pour point depressant.

DETAILED DESCRIPTION

Figure 1:
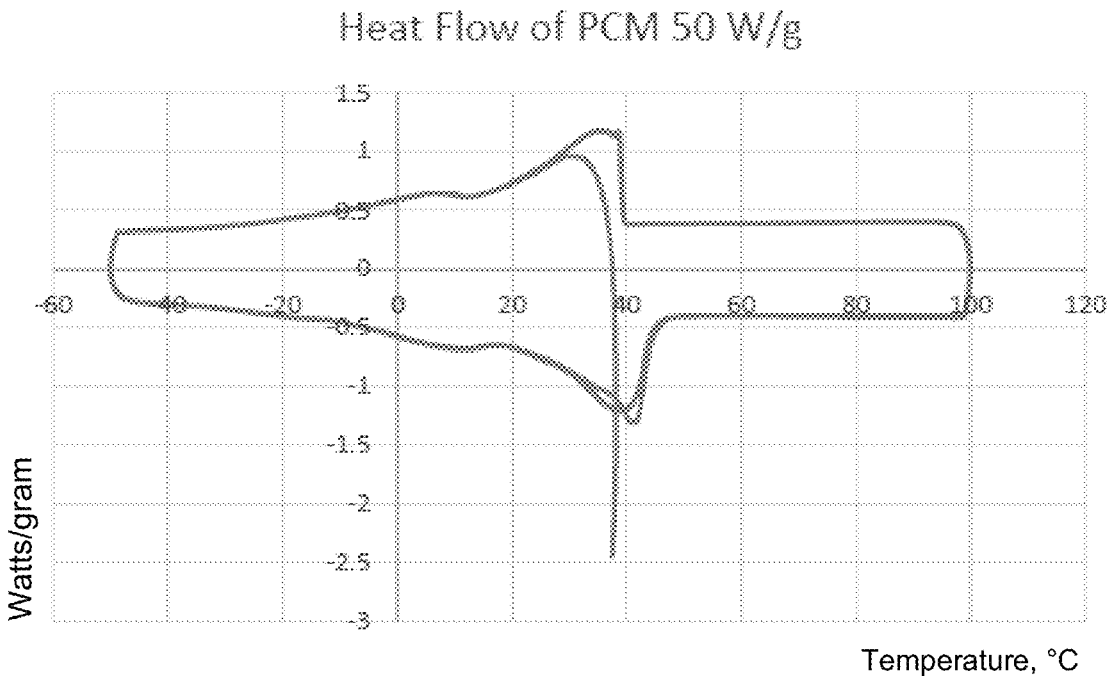
FIG. 1 is a Differential Scanning Calorimetry (DSC) graph showing melting and recrystallization of phase change material PCM50.

It has been discovered that the use of phase change materials (PCMs) together with pour point depressants (PPDs) can improve temperature and shear reversion problems of heavy fuels, and that the improvement can be synergistic.

PCMs are latent heat energy storage materials that undergo solid-liquid-gas phase transitions at specific temperature known as the phase transition temperatures. As the PCM absorbs energy from the surroundings, the material changes its phase from solid to liquid and/or liquid to gas while maintaining nearly constant temperature that corresponds to the phase transition temperature of the PCM. This amount of energy absorbed/released during phase transition is known as the latent heat. PCMs are typically separated into three categories: organic, inorganic, and eutectics (combinations of at least two PCMs).

As previously mentioned, the transport and handling of heavy oils, such as heavy fuel oils and crude oil, is a serious issue due to temperature cycling and/or shear reversion leading to gelling and precipitation. The use of PCM-based additives has been discovered to solve the challenge as will be described. The advantages of using PCMs in this application include, but are not necessarily limited to:

- Avoiding gelling and precipitation of heavy fuels,
- Avoiding unwanted remains in transport of fuels.
- Providing a synergistic effect by formulating PPDs together with PCMs.

Depending on the choice of appropriate PCMs, the properties can be tuned or customized for the need of temperature and shear conditions. The cost of PCMs can vary between low to moderate depending on the chemistry that is selected; in one non-limiting embodiment from about \$0.20/lb to about \$3/lb (about \$0.09/kg to about \$1.36/kg). As will be discussed, blending with existing additives can bring about a synergistic effect in reversion improvement.

It is expected that the method and additives herein are effective and applicable to a wide variety of heavy oils, including, but not necessarily limited to, crude oil, heavy fuel oils, gas oils, bottom resids, and combinations thereof. "Bottom resids", also known as "vacuum resids" are well known in the art as the heaviest of distillation cuts; literally the bottom of the barrel.

It is also expected that a wide variety of PCMs are applicable in the methods and additives herein including, but not necessarily limited to, organic phase change materials, inorganic phase change materials, and eutectic mixtures of at least two-phase change materials.

In more detail, organic phase change materials include, but are not necessarily limited to, paraffin hydrocarbons (including, but not necessarily limited to, hexadecane, heptadecane, octadecane, nonadecane, eicosane, heneicosane, docosane, tricosane, tetracosane, pentacosane, hexacosane, octacosane, triacontane); fatty acids (including, but not necessarily limited to, caprylic acid, capric acid, lauric acid, myristic acid, palmitic acid, stearic acid); polyalcohols (including, but not necessarily limited to, pentaerythritol (PE), pentaglycerine (PG), neopentylglycol (NPG), aminoglycol (AMPL), tris-amino-$CH_4$ (TAM)), and combinations of these.

Suitable inorganic PCMs include, but are not necessarily limited to, salt hydrates. These salt hydrates are typically alloys of inorganic salts and water forming a crystalline solid of the general formula $AB_n \cdot H_2O$, where n ranges from 1 to 8. Specific, non-restrictive examples include, but are not necessarily limited to, $CaCl_2.12H_2O$; $LiNO_3.2H_2O$; $LiNO_3.3H_2O$; $KFe(SO_4)_2.12H_2O$; $LiBr_2.2H_2O$; $FeCl_3 \cdot H_2O$; $CoSO_4.7H_2O$; $Ca(NO_3).4H_2O$; $Fe(NO_3)_3.9H_2O$; $Ca(NO_3)_2.3H_2O$; $FeCl_3.2H_2O$; $CH_3COONa.3H2O$; $MgCl_2.4H_2O$; $NaAl(SO_4)_2.10H_2O$; $NaOH \cdot H_2O$; $Al(NO_3)_2.9H_2O$; $MgCl_2.6H_2O$; and combinations of these.

Suitable inorganic PCMs also include, but are not necessarily limited to, metals such as gallium; Cerrolow eutectics; Bi—Cd—In eutectic; Cerrobend eutectics; Bi—Pb—In eutectic; Bi—In eutectic; and combinations of these.

Other suitable PCM eutectics include, but are not necessarily limited to, triethylolethane+water+urea; $CaCl+2MgCl_2.6H_2O$; $CH_3CONHH+2NH_2CONH_2$; triethylolethane+urea; $CH_3COONa.3H_2O+NH_2CONH_2$; $NH_2CONH+2NH_2NO_3$; $Mg(NO_3)_3.6H2O+NH_4O_3$; $Mg(NO_3)_36H_2O+MgCl_2.6H_2O$; $Mg(NO_3)_3.6H_2O+MgBr_2.6H_2O$; $NH_2CONH_2+NH_4Br$; and combinations thereof.

In one non-limiting embodiment, PCM50 is a suitable PCM. PCM 50 is a paraffin wax which is generally a mixture of alkanes. Since pure paraffin hydrocarbons are expensive to obtain, it is easier to use paraffin waxes also known as grade paraffin. They possess the same properties as pure alkanes, but their melting point is an average of all the alkanes present in it. Commercial grade paraffin waxes are reported to be able to sustain over 1500 cycles while maintaining their properties unchanged. Unless the practical application defines a precise temperature for the PCM to be melted, paraffin waxes are optimal cost-effective substitutes.

In another specific embodiment, polyolefin waxes are suitable as PCMs. These polyolefin waxes are dimer olefins of structure (I) made by the following reaction:

(I)

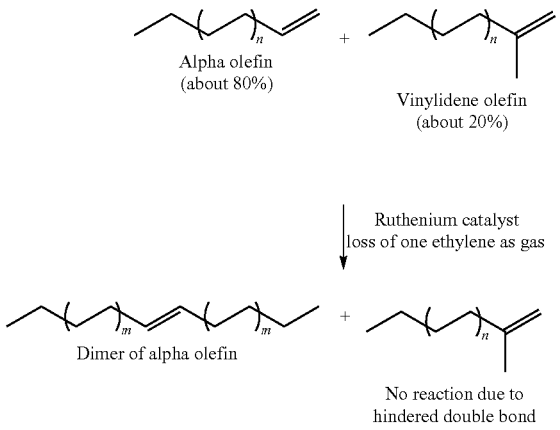

where in this case n ranges from 2 to 40 and m ranges from 2 to 40.

Turning to the other component of the additive, suitable PPDs include, but are not necessarily limited to, ethyl vinyl acetate copolymers, alpha-olefin maleic anhydrides, vinyl acetate olefin maleic anhydride copolymers, polymeric amides and imides, and/or poly alkyl acrylic polymers.

More specifically, suitable ethyl vinyl acetate copolymers include those of the structure (II):

(II)

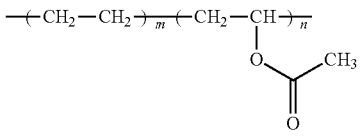

where in this case, m ranges from 10 to 90 and n ranges from 10 to 90.

Suitable alpha-olefin maleic anhydrides for PPDs include, but are not necessarily limited to, those of the structure (III):

(III)

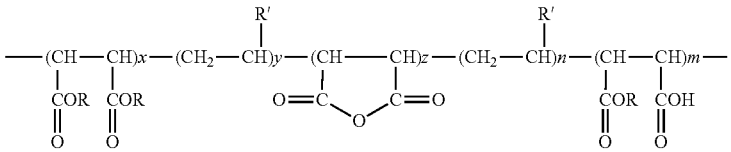

where in this case R is hydrogen or alkyl, where the alkyl is straight or branched and has 1 to 30 carbon atoms; R' is alkyl; x ranges from 5 to 20; y ranges from 2 to 20; z ranges from 5 to 20; n ranges from 2 to 20; and m ranges from 5 to 20.

Suitable vinyl acetate olefin maleic anhydride copolymers for PPDs include, but are not necessarily limited to, those having the structure (IV):

(IV)

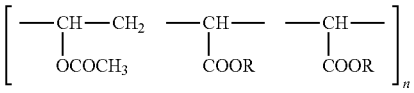

where in this case n ranges from 10 to 75.

Suitable polymeric amides and imides for PPDs include those of the following structures (V), (VI), and (VII):

(V)

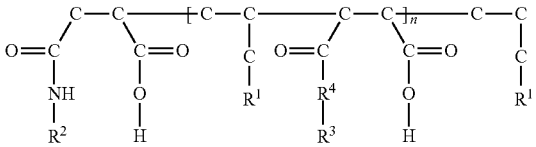

(VI)

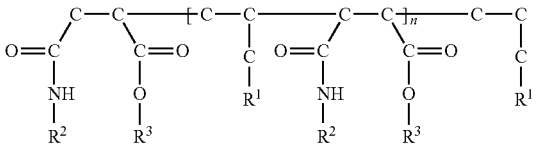

(VII)

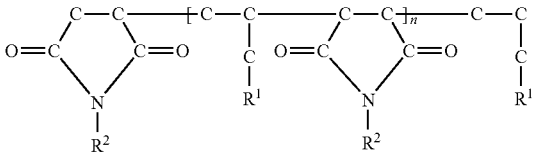

where $R^1$ is hydrogen or alkyl, where the alkyl is straight or branched and has 1 to 30 carbon atoms; $R^2$ is alkyl; $R^3$ is hydrogen or alkyl; $R^4$ is oxygen or NH; and n ranges from 5 to 36.

Suitable poly alkyl acrylic polymers for use as PPDs include, but are not necessarily limited to, those of structure (VIII):

(VIII)

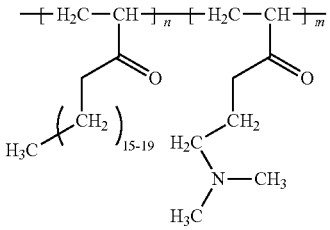

where n ranges from 5 to 20 and m ranges from 5 to 20.

In a particular, suitable non-limiting embodiment, the PPD can be a maleic anhydride alpha-olefin polymer.

As mentioned, the additive introduced into the heavy oil contains both a PCM and a PPD in an effective amount of to mitigate the reversion problem of the heavy oil. The effective amount of PCM ranges from about 1 ppm independently to 2,000 ppm based on the heavy oil; alternatively, from about 10 ppm independently to 500 ppm. The effective amount of PPD ranges from about 10 ppm independently to 20,000 ppm based on the heavy oil; alternatively, from about 100 ppm independently to 5,000 ppm. As used herein with respect to a range, the term "independently" means that any given threshold can be combined with any other given threshold for that parameter to give a suitable alternative range. For example, the effective amount of PPD may range from 10 to 5,000 ppm based on the heavy oil.

It is not necessary for the reversion problem to be completely eliminated for the method to be considered successful, although that is certainly an acceptable outcome. It is sufficient for the reversion problem to be mitigated or reduced. In one non-limiting embodiment the treated heavy oil should be able to flow, for instance to be pumped or poured. In one non-limiting embodiment, the treated heavy oil has a temperature in the range of from about −10° F. (−23° C.) independently to about 250° F. (121° C.); in another non-restrictive version up to 100° F. (38° C.); alternatively, from about 0° F. (−18° C.) independently to about 70° F. (21° C.).

As will be demonstrated, in a particular non-restrictive version, the additive synergistically mitigates reversion of the heavy oil as compared with introducing the phase change material alone in the same total amount and also as compared with introducing the pour point depressant alone in the same total amount.

The invention will be further described with respect to the following Examples, which are not meant to limit the invention, but rather to further illustrate some embodiments.

EXAMPLES

In the following Examples, the same heavy fuel oil was used in all Examples. The PPD used was maleic anhydride alfa olefin polymer. The PCM used was PCM50, as previously defined. When a mixture of PPD and PCM50 was used, it was 5 wt % PCM in the PPD.

Table I presents data demonstrating the need for a temperature and shear reversion prevention additive, where all three Examples gelled; Examples 2 and 3 gelled even though 1250 ppm and 2500 ppm PPD were present in the heavy fuel oil.

TABLE I

Need for Temperature and Shear Reversion Prevention Additive

| Ex. | Additive | Dose, ppm | Pour point, ° F. (° C.) | Thermal Reversion ° F. (° C.) | Shear Reversion 0 hr. ° F. (° C.) | Shear Reversion, 1 hr. ° F. (° C.) | Shear Reversion at Room Temperature |
|---|---|---|---|---|---|---|---|
| 1 | Blank | — | 65 (18) | 75 (24) | 75 (24) | 75 (24) | Gelled |
| 2 | PPD | 1250 | 50 (10) | 60 (16) | 65 (18) | 65 (18) | Gelled |
| 3 | PPD | 2000 | 40 (4) | 50 (10) | 65 (18) | 65 (18) | Gelled |

Table II presents the results using an additive of PCM50 (5 wt %) and PPD showing the benefit of including PCM50 for improving thermal reversion. The reference to "cycles" in Examples 6 and 7 refers to heating and cooling cycles from DSC measurements. It may be clearly seen that thermal reversion is improved (lowered) in Examples 5, 6, and 7 where PCM50 was included in the additive.

TABLE II

Benefit of Including PCM50 to Improve Reversion

| Ex. | Sample | Additive | Dose, ppm | Pour Point ° F. (° C.) | Thermal Reversion ° F. (° C.) |
|---|---|---|---|---|---|
| 1 | Fuel Oil | Blank | — | 65 (18) | 75 (24) |
| 4 | Fuel Oil | PPD | 1000 | 55 (13) | 60 (16) |
| 5 | Fuel Oil | PPD/PCM50 | 1000 | 50 (10) | 45 (7) |
| 6 | Fuel Oil (Cycle 2) | PPD/PCM50 | 1000 | 50 (10) | 50 (10) |
| 7 | Fuel Oil (Cycle 3) | PPD/PCM50 | 1000 | 50 (10) | 50 (10) |

Table III presents the results of using the same total amount of additive (1250 ppm) where Example 2 used only PPD, Example 8 used the inventive mixture of PPD and PCM50, and Example 9 used only PCM50. Example 1 is a blank for comparison. Evidence of synergism is seen in the results for thermal reversion and shear reversion after 1 hour. More specifically, the thermal reversion for Ex. 2 (PPD only) was 60° F. (16° C.) and the thermal reversion for Ex. 9 (PCM50 only) was 70° F. (21° C.); thus, one of ordinary skill in the art would expect the thermal reversion for Ex. 8 (PPD/PCM50) to be between 60° F. (16° C.) and 70° F. (21° C.), but it was unexpectedly (more than the either of the reductions for Ex. 2 and 9) at 55° F. (13° C.). Similarly, the 1-hour shear reversion for Ex. 2 (PPD only) was 65° F. (18° C.) and the 1-hour shear reversion for Ex. 9 (PCM50 only) was also 65° F. (18° C.); thus, one of ordinary skill in the art would expect the thermal reversion for Ex. 8 (PPD/PCM50) to also be 65° F. (18° C.), but it was unexpectedly much lower at 40° F. (4° C.).

TABLE III

Comparison of PPD and PCM50 used Alone and Together

| Ex. | Additive | Dose, ppm | Pour Point ° F. (° C.) | Thermal Reversion ° F. (° C.) | Shear Reversion 0 hr, ° F. (° C.) | Shear Reversion 1 hr, ° F. (° C.) |
|---|---|---|---|---|---|---|
| 1 | Blank | — | 65 (18) | 75 (24) | 75 (24) | 75 (24) |
| 2 | PPD | 1250 | 50 (10) | 60 (16) | 65 (18) | 65 (18) |
| 8 | PPD/PCM50 | 1250 | 55 (13) | 55 (13) | 75 (24) | 40 (4) |
| 9 | PCM50 | 1250 | 65 (18) | 70(21) | 85 (29) | 65 (18) |

DSC Data

Figure 2:
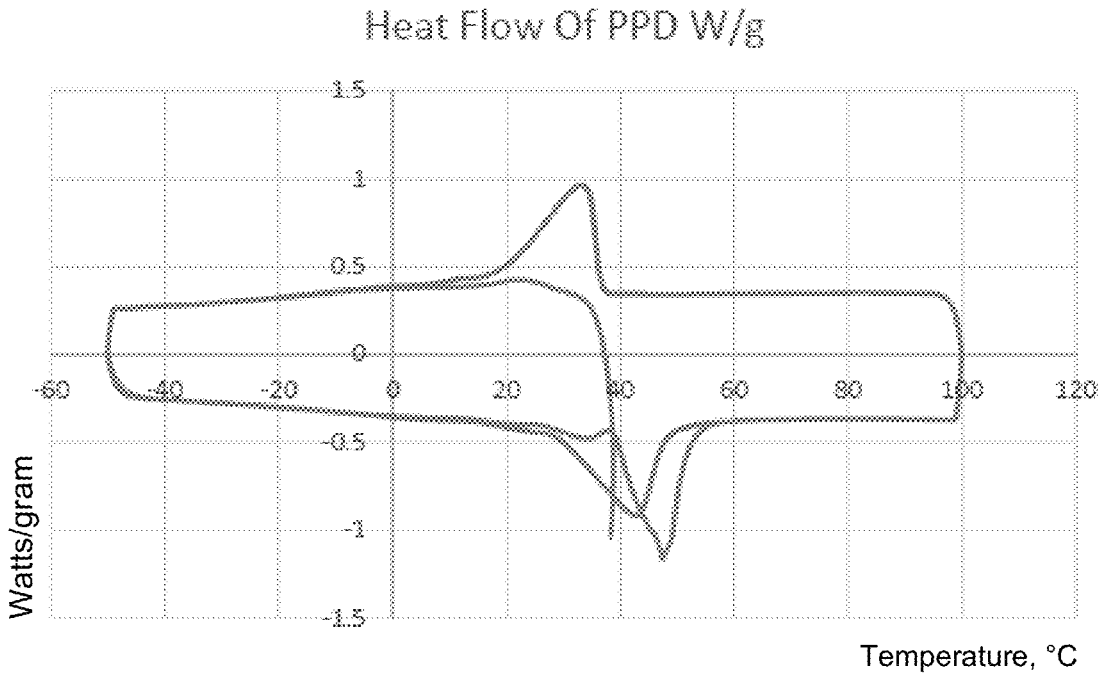
FIG. 2 is a DSC graph showing melting and recrystallization of a pour point depressant (PPD)
Figure 3:
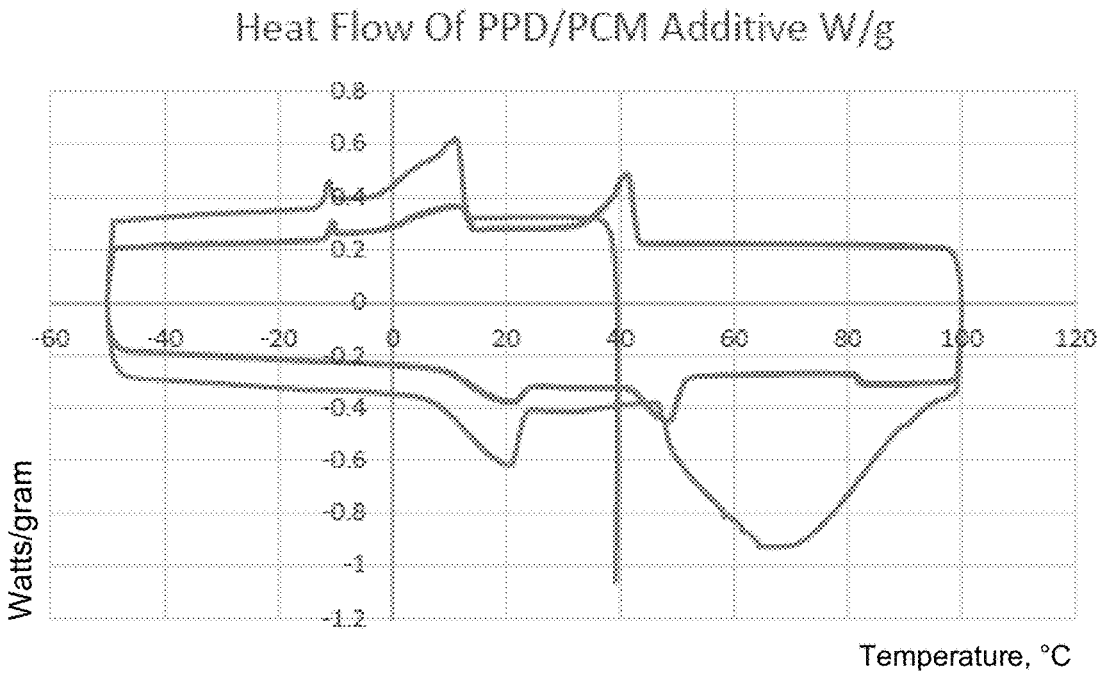
FIG. 3 is a DSC graph showing melting and recrystallization of a mixture of PCM50 and the PPD tested in FIGS. 1 and 2, respectively.

Differential Scanning Calorimetry (DSC) measurements of PCM50 show melting and recrystallization of PCM50 as reported in FIGS. 1 (PCM50), 2 (PPD), and 3 (PPD/PCM50). The heating and cooling cycle of FIG. 1 shows that PCM50 starts to melt at around 20° C. (20° C.-45° C.) and starts to recrystallize at around 40° C. (40° C.-15° C.). In FIGS. 1-3, the x-axis is temperature in ° C., and the y-axis is energy input in watts/gram (W/g).

The heating and cooling cycle of FIG. 2 shows that the PPD starts to melt at around 20° C. and covers a temperature range of (20° C.-50° C.) and starts to recrystallize at around 40° C. (40° C.-10° C.).

The heating and cooling cycle of FIG. 3 shows that the PPD/PCM50 mixture has two melting temperatures between 5° C.-25° C. and 40° C.-50° C. with the corresponding recrystallization covering the ranges of 40° C.-30° C. and 15° C. to −10° C. While the DSC is showing evaporation of solvent during the heating cycle, the addition of PCM50 to the PPD has delayed the recrystallization temperature of the resulting mixture to below 15° C. and part of the mixture also starts to recrystallize at 40° C. respectively. It is clear that part of the mixture is melting at a lower temperature and recrystallizing at a lower temperature respectively and this may be playing a part in the prevention of thermal reversion by the PPD/PCM50 mixture as compared with the PPD alone.

Figure 4:
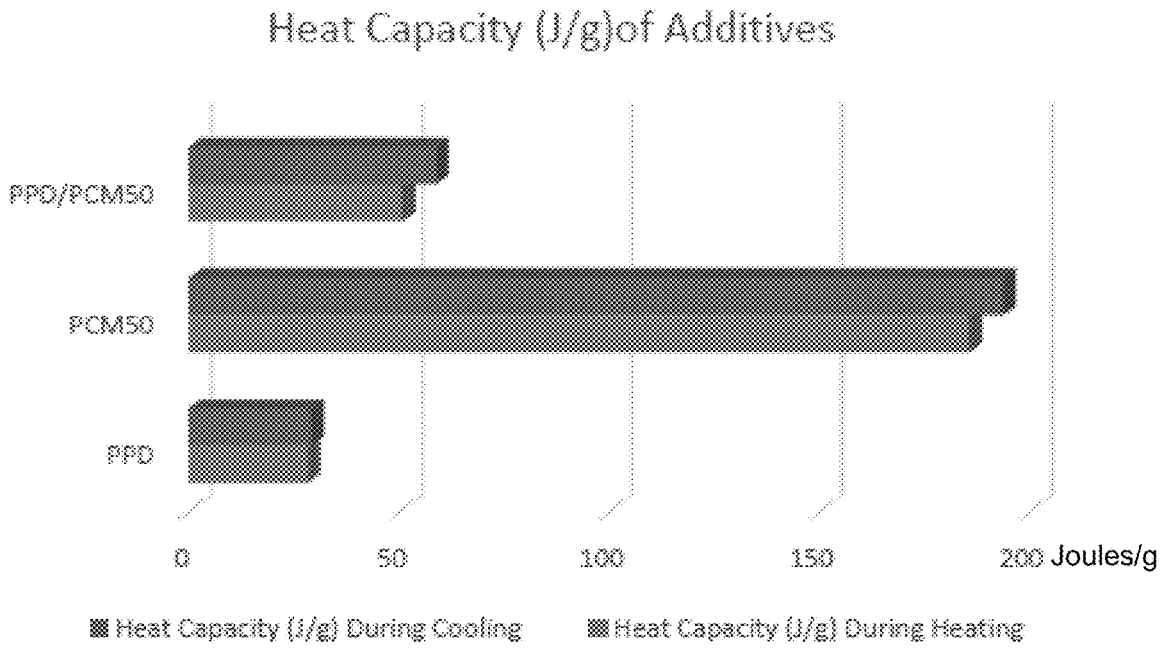
FIG. 4 is a bar graph of the heat capacity of the PPD of FIG. 2, PCM50 of FIG. 1, and the mixture of PCM50 and the PPD of FIG. 3 in Joules/gram (J/g) during cooling and during heating.

Heat capacity results are presented in Table IV and FIG. 4 (graphic presentation of Table IV data). The heat capacity obtained during heating and cooling shows that the PPD additive adsorbs and releases about the same amount of energy during heating and cooling while both PCM50 and the PPD/PCM50 mixture give out more heat during cooling. This liberation of energy during recrystallization of the PCM50 material is advantageous to the PPD/PCM50 mixture in helping improve thermal performance and thermal reversion prevention using this additive. Hence, a small addition of PCM facilitates the PPD to perform better. Similar kinds of data may be obtained for other PPD and PCM materials to design other additives having a PPD and a PCM to improve thermal cycling and/or mechanical shearing (reversion problems) in heavy fuel oils.

TABLE IV

Heat Capacity Results

| Ex. | Additive | Heat Capacity (J/g) During Heating | Heat Capacity (J/g) During Cooling |
|---|---|---|---|
| 10 | PPD | 28.2 | 28.91 |
| 11 | PCM50 | 185.4 | 193.6 |
| 12 | PPD/PCM50 | 50.6 | 58.8 |

In the foregoing specification, the invention has been described with reference to specific embodiments thereof. However, it will be evident that various modifications and changes can be made thereto without departing from the broader scope of the invention as set forth in the appended claims. Accordingly, the specification is to be regarded in an illustrative rather than a restrictive sense. For example, different heavy oils, different PPDs, different PCMs, weight ratios, different dosages, different temperatures, and amounts not specifically identified or described in this disclosure or not evaluated in a particular Example are still expected to be within the scope of this invention.

The present invention may suitably comprise, consist or consist essentially of the elements disclosed and may be practiced in the absence of an element not disclosed. For instance, there is provided a method to mitigate a reversion problem of a heavy oil, where the method comprises, consists essentially of, or consists of, introducing into the heavy oil having the reversion problem an effective amount of an additive to mitigate the reversion problem where the additive comprises both a phase change material and a pour point depressant thereby providing a treated heavy oil.

There may be additionally provided a treated heavy oil comprising, consisting essentially of, or consists of, heavy oil having a reversion problem, and an effective amount of an additive to mitigate the reversion problem where the additive comprises both a phase change material and a pour point depressant.

The words "comprising" and "comprises" as used throughout the claims, are to be interpreted to mean "including but not limited to" and "includes but not limited to", respectively.

As used herein, the singular forms "a," "an," and "the" are intended to include the plural forms as well, unless the context clearly indicates otherwise.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

What is claimed is:

1. A method to mitigate a reversion problem of a heavy oil, comprising:

introducing into the heavy oil having the reversion problem an effective amount of an additive to mitigate the reversion problem where the additive comprises both:

a phase change material that can absorb, store and liberate latent heat at a nearly constant phase-transition temperature, and a pour point depressant, where the additive provides a synergistic effect that mitigates the reversion problem better than the phase change material alone in the same total amount or the pour point depressant alone in the same total amount; and providing a treated heavy oil.

2. The method of claim 1 further comprising subsequently subjecting the treated heavy oil to a phenomenon selected from the group consisting of:

thermal cycling;

mechanical shearing; and combinations thereof, and the reversion problem is mitigated.

3. The method of claim 1 where the heavy oil is selected from the group consisting of crude oil, heavy fuel oils, gas oils, bottom resids, and combinations thereof.

4. The method of claim 1 where the effective amount of the additive comprises:

from about 1 ppm to 2,000 ppm of the phase change material; and from about 10 ppm to about 20,000 ppm of the pour point depressant, based on the heavy oil.

5. The method of claim 1 where:

the phase change material is selected from the group consisting of:

organic phase change materials, inorganic phase change materials, eutectic mixtures of at least two-phase change materials and combinations thereof; and the pour point depressant is selected from the group consisting of:

ethyl vinyl acetate copolymers, alpha-olefin maleic anhydrides, vinyl acetate olefin maleic anhydride copolymers, polymeric amides and imides, poly alkyl acrylic polymers, and combinations thereof.

6. The method of claim 1 where the treated heavy oil has a temperature in the range of from about −10° F. (−23° C.) to about 250° F. (121° C.).

7. A method to mitigate a reversion problem of a heavy oil, comprising:

introducing into the heavy oil having the reversion problem an effective amount of an additive to mitigate the reversion problem where the additive comprises both:

from about 1 ppm to 2,000 ppm of a phase change material, based on the heavy oil, where the phase change material can absorb, store and liberate latent heat at a nearly constant phase-transition temperature, and where the phase change material is selected from the group consisting of:

organic phase change materials, inorganic phase change materials, eutectic mixtures of at least two-phase change materials and combinations thereof, and from about 10 ppm to about 20,000 ppm of a pour point depressant, based on the heavy oil, where the pour point depressant is selected from the group consisting of:

ethyl vinyl acetate copolymers, alpha-olefin maleic anhydrides, vinyl acetate olefin maleic anhydride copolymers, polymeric amides and imides, poly alkyl acrylic polymers, and combinations thereof; and where the additive provides a synergistic effect that mitigates the reversion problem better than the phase change material alone in the same total amount or the pour point depressant alone in the same total amount;

providing a treated heavy oil; and subsequently subjecting the treated heavy oil to a phenomenon selected from the group consisting of thermal cycling, mechanical shearing, and combinations thereof, where the reversion problem is mitigated.

8. The method of claim 7 where the heavy oil is selected from the group consisting of crude oil, heavy fuel oils, gas oils, bottom resids, and combinations thereof.

9. The method of claim 7 where the treated heavy oil has a temperature in the range of from about −10° F. (−23° C.) to about 250° F. (121° C.).

10. A treated heavy oil, comprising:

heavy oil having a reversion problem; and an effective amount of an additive to mitigate the reversion problem where the additive comprises both:

a phase change material that can absorb, store and release latent heat at a nearly constant phase-transition temperature, and a pour point depressant, where the additive provides a synergistic effect that mitigates the reversion problem better than the phase change material alone in the same total amount or the pour point depressant alone in the same total amount.

11. The treated heavy oil of claim 10 where the heavy oil is selected from the group consisting of crude oil, heavy fuel oils, gas oils, bottom resids, and combinations thereof.

12. The treated heavy oil of claim 10 where the effective amount of the additive comprises:

from about 1 ppm to 2,000 ppm of the phase change material; and from about 10 ppm to about 20,000 ppm of the pour point depressant, based on the heavy oil.

13. The treated heavy oil of claim 10 where:

the phase change material is selected from the group consisting of:

organic phase change materials, inorganic phase change materials, eutectic mixtures of at least two-phase change materials, and combinations thereof; and the pour point depressant is selected from the group consisting of:

ethyl vinyl acetate copolymers, alpha-olefin maleic anhydrides, vinyl acetate olefin maleic anhydride copolymers, polymeric amides and imides, poly alkyl acrylic polymers, and combinations thereof.

14. The treated heavy oil of claim 10 where the treated heavy oil has a temperature in the range of from about −10° F. (−23° C.) to about 250° F. (121° C.).

* * * * *

5